US005651196A

United States Patent [19]

Hsieh

[11] Patent Number: 5,651,196

[45] Date of Patent: Jul. 29, 1997

[54] HIGHLY ELASTIC FOOTWEAR SOLE

[76] Inventor: Frank Hsieh, 9th-1 Floor, Kuang Fu South Road, Taipei, Taiwan

[21] Appl. No.: 585,015

[22] Filed: Jan. 11, 1996

[51] Int. Cl.[6] ..... A43B 13/28; A43B 13/18

[52] U.S. Cl. ..... 36/27; 36/28; 36/37; 36/38

[58] Field of Search ..... 36/27, 28, 3 B, 36/3 R, 37, 38

[56] References Cited

U.S. PATENT DOCUMENTS

| | | | |
|---|---|---|---|
| 904,891 | 11/1908 | Otterstedt | 36/28 |
| 2,437,227 | 3/1948 | Hall | 36/28 |
| 2,454,951 | 11/1948 | Smith | 36/38 |
| 2,535,102 | 12/1950 | Taylor | 36/38 |
| 4,322,893 | 4/1982 | Halvorsen | 36/28 |
| 4,747,219 | 5/1988 | Ammendolea | 36/28 |
| 5,513,448 | 5/1996 | Lyons | 36/28 |
| 5,537,762 | 7/1996 | Walters | 36/28 |

*Primary Examiner*—M. D. Patterson
*Attorney, Agent, or Firm*—Browdy and Neimark

[57] ABSTRACT

A highly elastic shoe sole comprises a lower layer, an upper layer, and a flexible cushion sandwiched between the lower layer and the upper layer. The lower layer is provided with a plurality of containers for holding compression springs serving to provide the shoe sole with elastic force. The upper layer of a soft material serves to provide a shoe wearer with a wearing comfort. The flexible cushion of a corrugated construction is provided in the underside thereof with a plurality of grooved portions and ridged portions corresponding in location to the containers of the lower layer.

19 Claims, 5 Drawing Sheets

HIGHLY ELASTIC FOOTWEAR SOLE

FIELD OF THE INVENTION

The present invention relates generally to a footwear, and more particularly to a highly elastic sole of the footwear.

BACKGROUND OF THE INVENTION

The conventional elastic shoe soles are generally made of an elastic plastic material; nevertheless they do not provide an adequate resiliency as desired. In an effort to enhance the elasticity of the shoe soles, the makers of shoes have devised shoe soles which are provided with an air cushion or inflatable air bag. However, such conventional elastic shoe soles as described above are inherently defective in design in that the elastic coefficient of the air cushion or air bag is not as high as desired, and that the air cushion and the air bag are rather vulnerable to air leak.

SUMMARY OF THE INVENTION

It is therefore the primary objective of the present invention to provide a shoe sole of a high elastic coefficient.

It is another objective of the present invention to provide a highly elastic shoe sole without an increase in thickness of the shoe sole.

It is still another objective of the present invention to provide a highly elastic shoe sole which is devoid of the leakage problem.

The foregoing objectives of the present invention are attained by a highly elastic footwear sole, which comprises a lower layer, an upper layer and a flexible cushion sandwiched between the lower layer and the upper layer. The lower layer is provided with a plurality of spring containers for holding within each a compression spring. The upper layer is made of a soft EVA, plastic or rubber material to provide the shoe wearer with a wearing comfort. The flexible layer is of a corrugated construction and is therefore composed of a plurality of grooved portions and ridged portions corresponding in location to the compression springs.

The foregoing objectives, features, functions and advantages of the present invention will be more readily understood upon a thoughtful deliberation oft he following detailed description of the present invention in conjunction with the accompanying drawings.

DETAILED DESCRIPTION OF THE INVENTION

Figure 1:
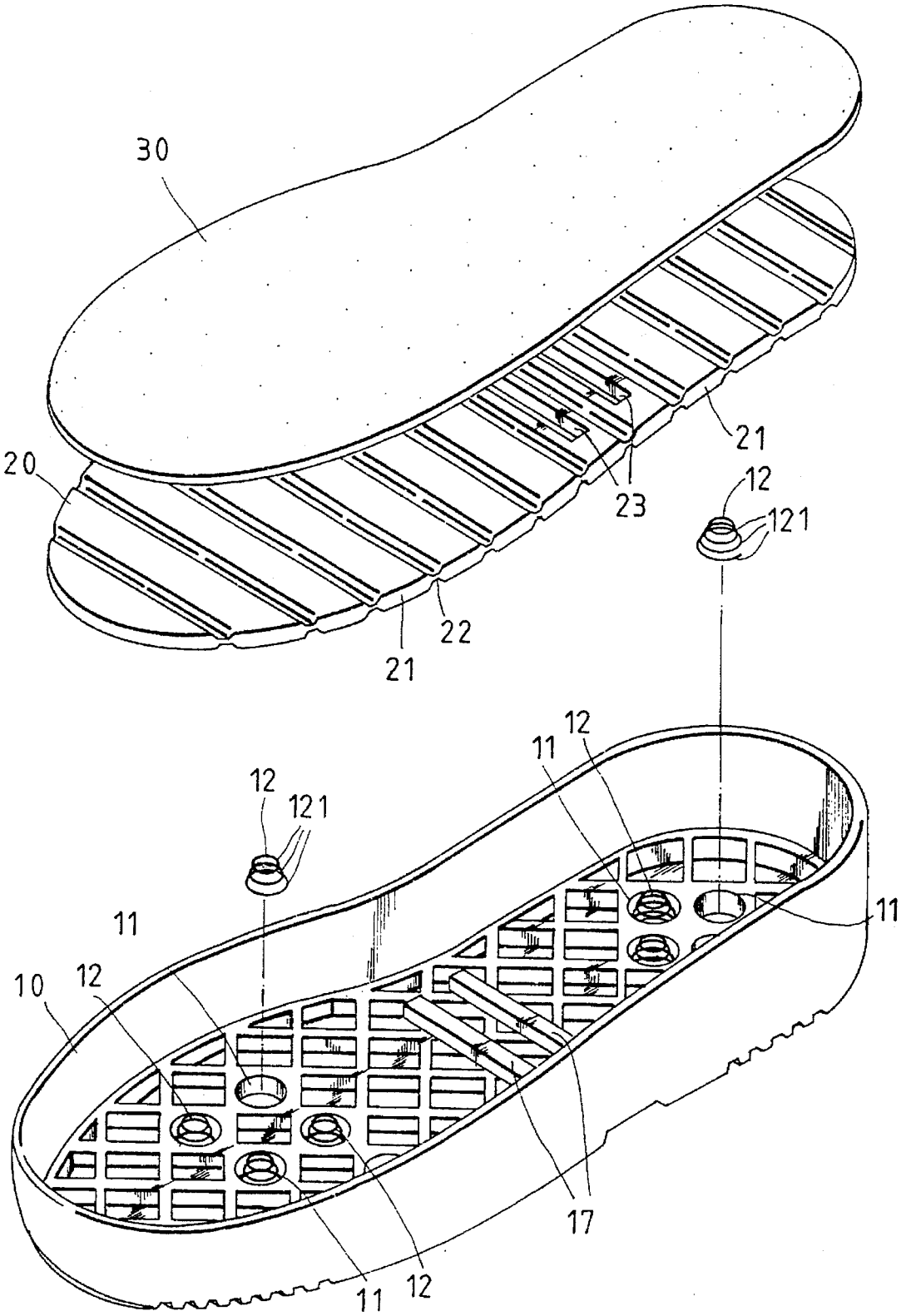
FIG. 1 shows an exploded view of a first preferred embodiment of the present invention.
Figure 2:
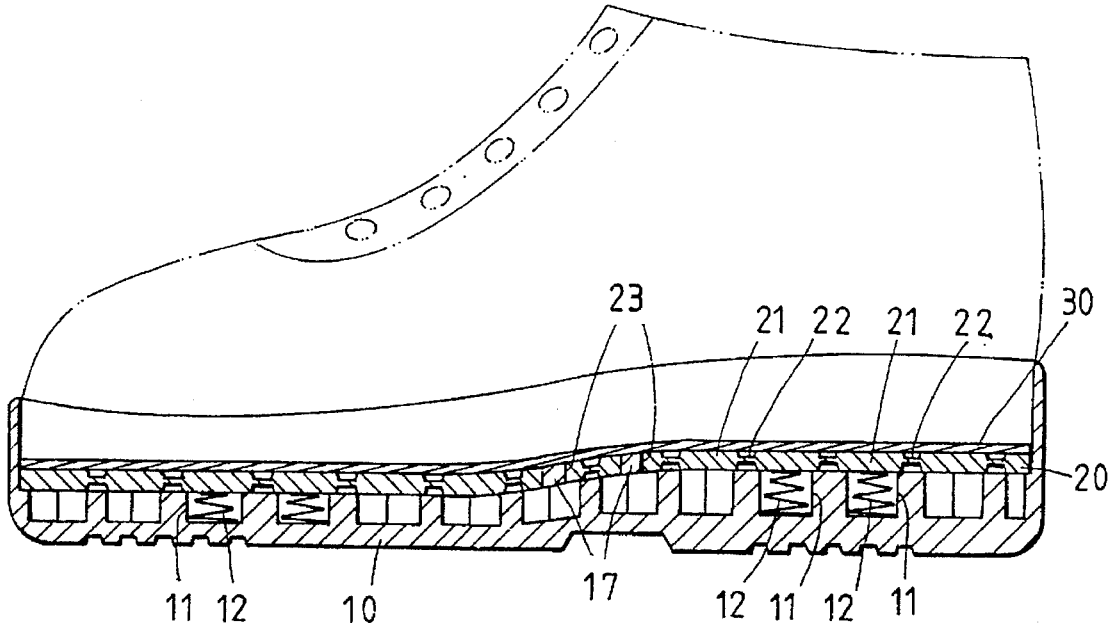
FIG. 2 shows a sectional view of the first preferred embodiment of the present invention in combination.

As shown in FIGS. 1 and 2, an elastic shoe sole of the first preferred embodiment of the present invention is composed of a lower layer 10, a flexible cushion 20, and an upper layer 30.

The lower layer 10 is made of an EVA foam material, a plastic material, or a rubber material. The lower layer 10 is provided integrally with a plurality of spring containers 11 and is further provided at the midsegment thereof with two or more retaining strips 17. The cells 11 are circular in shape and have a predetermined depth. The spring containers 11 have a bottom wall, which may be either transparent or opaque. The spring containers 11 are intended to receive therein securely a compression spring 12 which has a natural length greater than the depth of the spring containers 11. Each of the compression springs 12 has a coil 121.

The flexible cushion 20 of a plastic or rubber material is of a corrugated construction. As a result, the flexible cushion 20 has in the underside thereof a plurality of ridged portions 21 and grooved portions 22. The flexible cushion 20 is provided at the midsegment of the underside thereof with two or more retaining holes 23 which are corresponding in location to and engageable with the retaining strips 17 of the lower layer 10. The ridged portions 21 of the flexible cushion 20 are corresponding in location to the compression springs 12 for lessening the impact of the elastic force of the compression springs 12 on the upper layer 30 which makes direct contact with a foot sole.

The upper layer 30 is made of an EVA foam material, a soft plastic material or a rubber material, so as to provide a shoe wearer with a wearing comfort.

Figure 3:
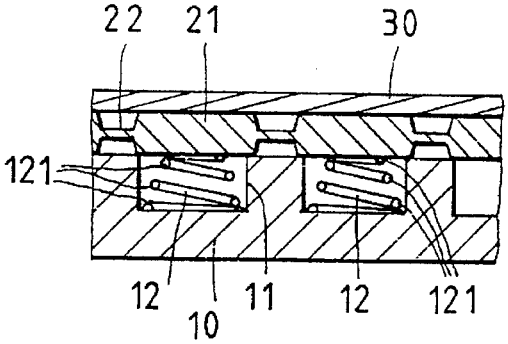
FIG. 3 is a partial enlarged view illustrating the state in which the compression springs of the first preferred embodiment of the present invention are not exerted on by an external force.
Figure 4:
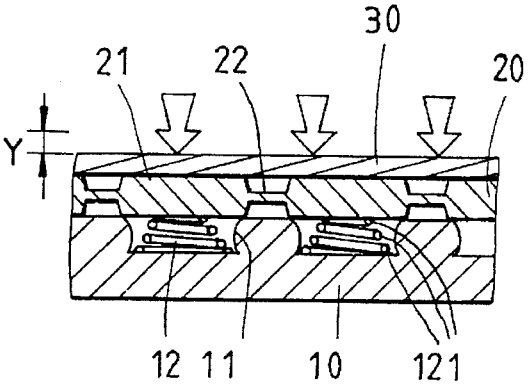
FIG. 4 is a partial enlarged view illustrating the state in which the compression springs of the first preferred embodiment of the present invention are exerted on by an external force.

The elastic characteristic of the shoe sloe of the present invention is schematically illustrated in FIGS. 3 and 4. As shown in FIG. 3, the upper layer 30 of the shoe sole of the present invention is not exerted on by a foot sole. Now referring to FIG. 4, the upper layer 30 is exerted on by the pressure of a foot sole such that the level of the surface of the upper layer 30 is lowered by a distance designated by the letter Y. The reaction force of the shoe sole is equal to the elastic force of the material forming the lower layer 10 plus the total elastic force of the compression springs 12. As compared with the elastic shoe sole of the prior art, the elastic shoe sole of the present invention is provided with a better elasticity in view of the fact that the elastic force of the compression springs 12 is far greater than the elastic force of the material forming the lower layer 10, and that the compression springs 12 are distributed mainly in the heel portion and the toe portion of the shoe sole of the present invention, with the heel portion and the toe portion being points of application.

It must be noted here that the present invention makes use of the spiral compression springs 12, each of which comprises a plurality of coils 121 which are less vulnerable to being jammed when the compression springs 12 are compressed repeatedly. Further, the flexible cushion 20 is also made of a flexible metal of thin plate to offer the flexibility and hardness.

Figure 5:
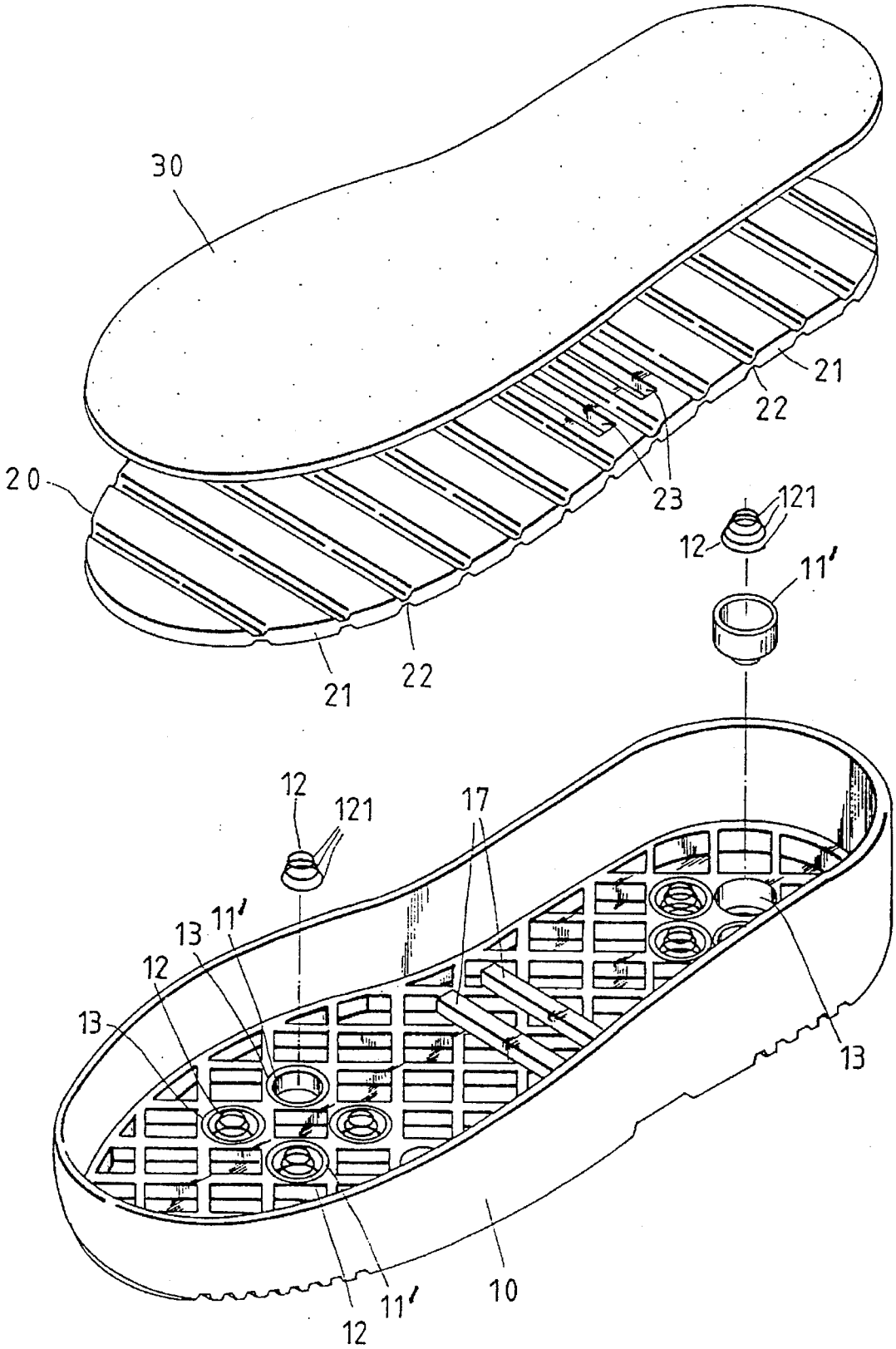
FIG. 5 shows an exploded view of a second preferred embodiment of the present invention.
Figure 6:
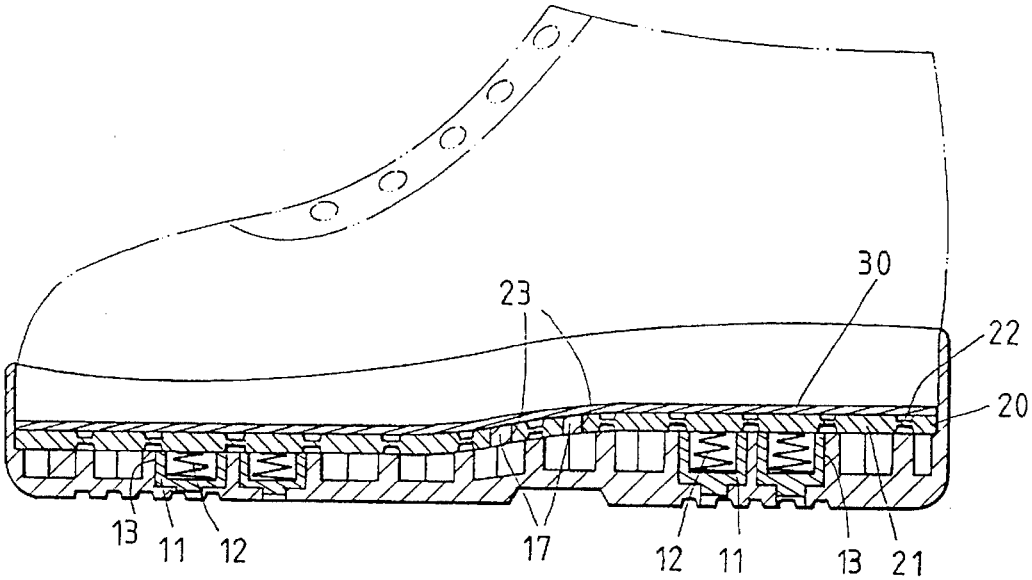
FIG. 6 shows a sectional view of the second preferred embodiment of the present invention in combination.

The shoe sole of the second preferred embodiment of the present invention comprises a plurality of detachable spring containers 11', each of which is secured to a spring container cell 13, as shown in FIGS. 5 and 6. The spring containers 11' are either transparent or opaque. The spring containers 11' may or may not be made of the material of which the lower layer 10 is made.

Figure 7:
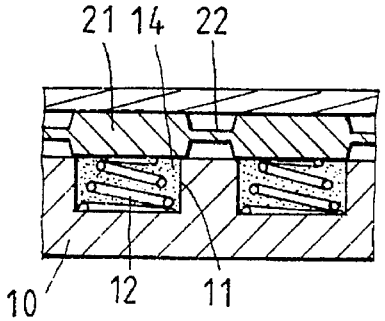
FIG. 7 shows a partial sectional view of a third preferred embodiment of the present invention.

As shown in FIG. 7, a shoe sole of the third preferred embodiment of the present invention comprises a plurality of the spring containers 11, each of which is stuffed with a soft filler 14 serving to help secure the compression spring 12.

Figure 8:
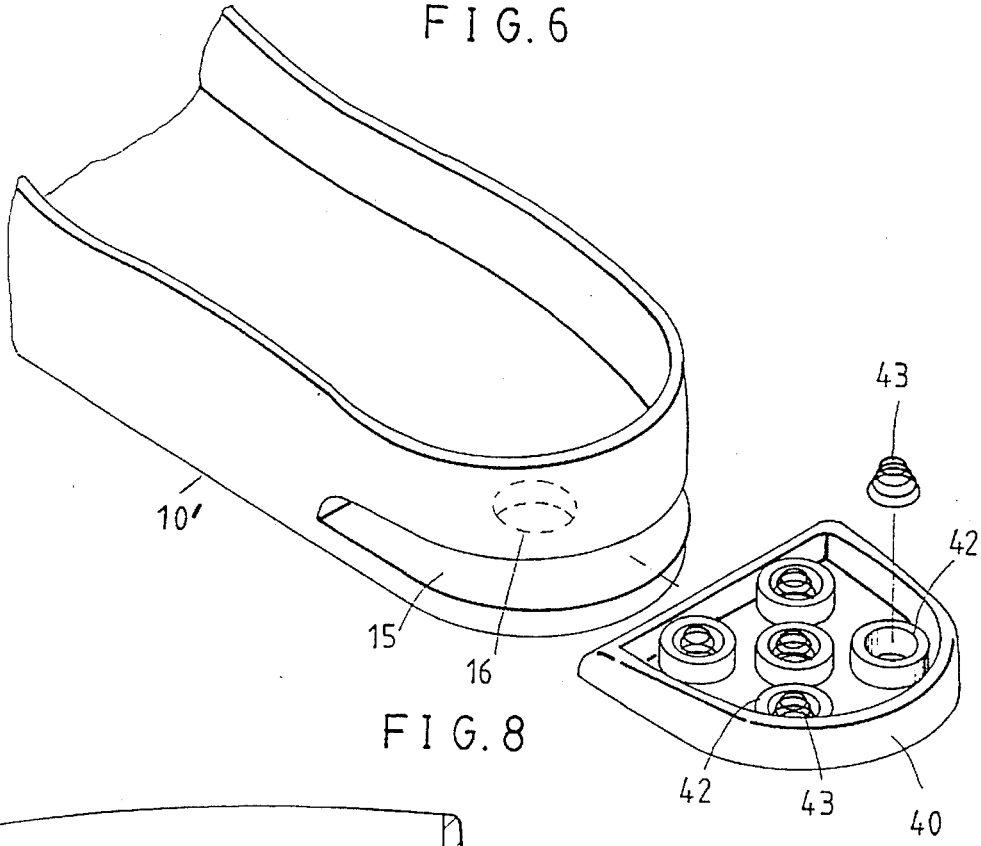
FIG. 8 shows an exploded view of a fourth preferred embodiment of the present invention.
Figure 9:
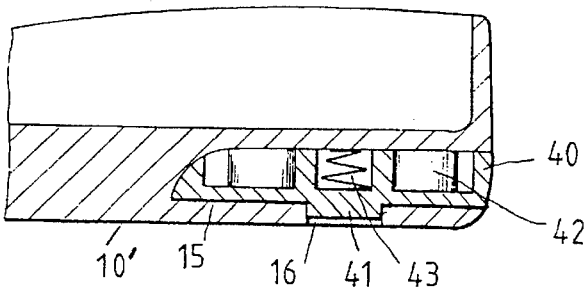
FIG. 9 shows a sectional view of the fourth preferred embodiment of the present invention in combination.
Figure 10:
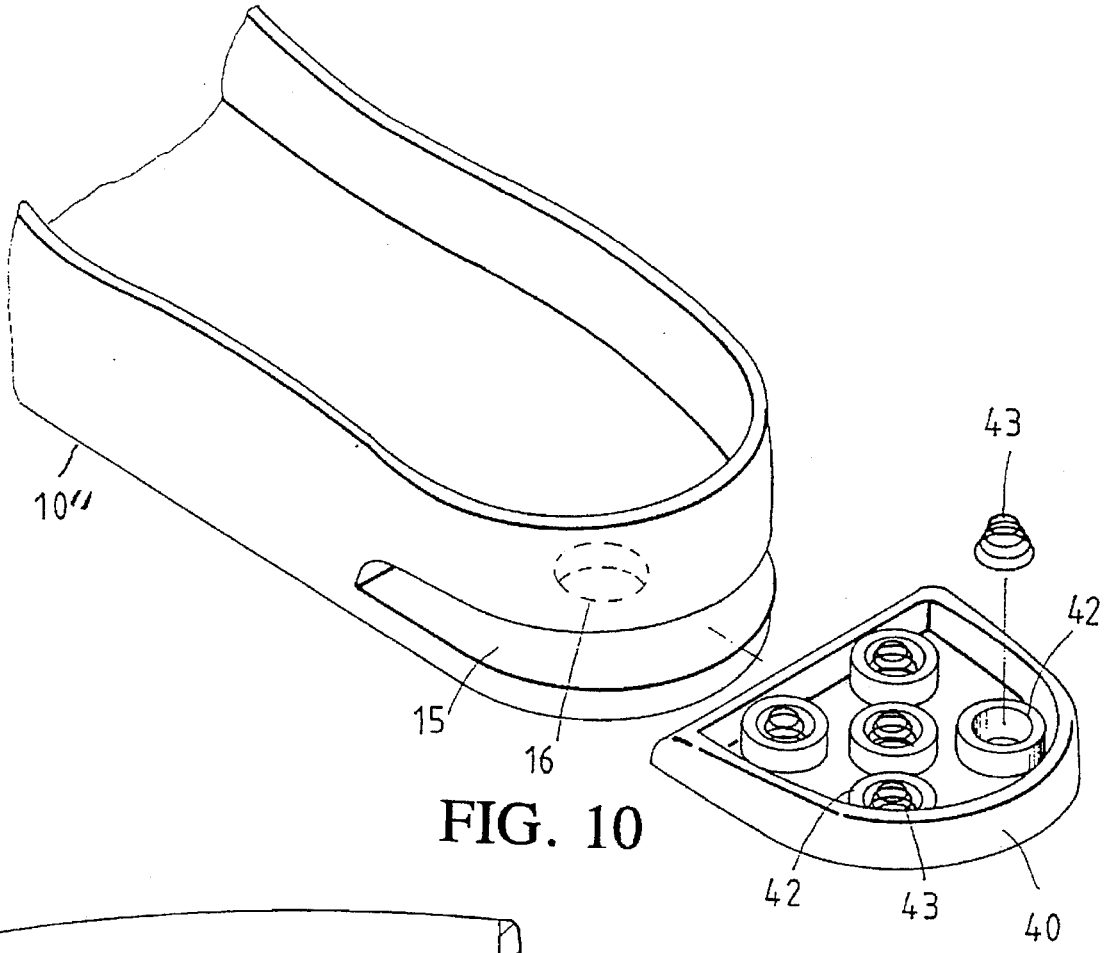
FIG. 10 shows an exploded view of a fifth preferred embodiment of the the present invention.
Figure 11:
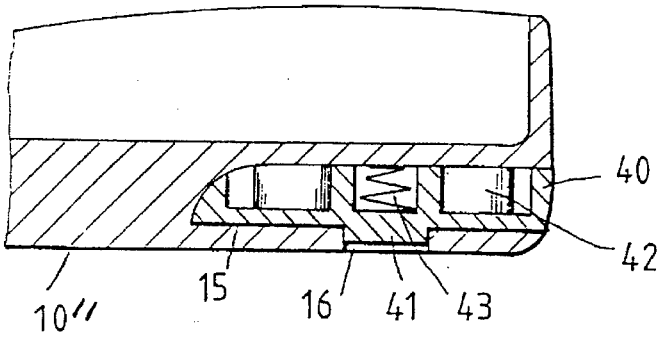
FIG. 11 shows a sectional view of the embodiment of FIG. 10.

As illustrated in FIGS. 8 and 9, a shoe sole of the fourth preferred embodiment of the present invention comprises a lower layer 10 which is provided in the heel end thereof with an opening 15 which is in turn provided in the wall thereof with an retaining slot 16. The lower layer 10 is further provided with an elastic element 40 which is corresponding in dimension to the opening 15 and is secured to the inside of the opening 15 such that a retaining projection 41 of the elastic element 40 is engaged with the retaining slot 16. The elastic element 40 is further provided with a plurality of spring containers 42, each of which accommodates a compression spring 43. The elastic element 40 serves to provide the heel end of the shoe sole of the present invention with a considerably greater elastic force. The toe end of the lower layer 10' may be similarly provided with the elastic element 40 as shown in the fifth preferred embodiment of FIGS. 10 and 11. The double primed elements of FIGS. 10 and 11 are as described above for the similarly numbered elements in FIGS. 8 and 9.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An elastic footwear sole comprising:

an upper layer of a soft material;

a lower layer, said lower layer provided with a plurality of containers retaining respectively therein a biasing means serving to provide said lower layer with elastic force;

a flexible cushion made of a flexible material, said flexible cushion being sandwiched between said upper layer and said lower layer, and wherein said lower layer is provided in a toe end thereof with an opening securing an elastic element which is composed of the plurality of containers accommodating the biasing means.

2. The elastic footwear sole as defined in claim 1, wherein said flexible cushion is a corrugated construction and having in an underside thereof a plurality of ridged portions and grooved portions, said flexible cushion being sandwiched between said upper layer and said lower layer such that said ridged portions are corresponding in location to said containers of said lower layer.

3. The elastic footwear sole as defined in claim 1, wherein said flexible cushion is a thin plate and made of hard and flexible metal.

4. The elastic footwear sole as defined in claim 1, wherein said biasing means is a spiral spring.

5. The elastic footwear sole as defined in claim 1, wherein said containers are made integrally with said elastic element.

6. The elastic footwear sole as defined in claim 1, wherein said elastic element is provided with a plurality of cells securing therein said containers.

7. The elastic footwear sole as defined in claim 6, wherein said containers are transparent.

8. The elastic footwear sole as defined in claim 1, wherein said containers are provided respectively therein with a filler securing said biasing means retained in said containers.

9. The elastic footwear sole as defined in claim 1, wherein said lower layer is provided in a side thereof with a retaining slot; and wherein said elastic element is provided with a retaining projection engageable with said retaining slot.

10. The elastic footwear sole as defined in claim 1, wherein said lower layer is provided on an upper surface thereof with one or more retaining strips; and wherein said flexible cushion is provided on an underside thereof with one or more retaining holes corresponding in location to and engageable with said retaining strips for locating said flexible cushion on said lower layer.

11. The elastic footwear sole of claim 1, wherein said lower layer is made of an EVA foam material.

12. The elastic footwear sole of claim 1, wherein said lower layer is made of a plastic material.

13. The elastic footwear sole of claim 1, wherein said lower layer is made of a rubber material.

14. An elastic footwear sole comprising:

an upper layer of a soft material;

a lower layer; said lower layer provided with a plurality of containers retaining respectively therein a biasing means serving to provide said lower layer with elastic force; and a flexible cushion made of a flexible material, said flexible cushion being sandwiched between said upper layer and said lower layer, wherein said lower layer is provided in a heel end thereof with an opening on a peripheral side edge of said lower layer and an elastic element secured in said opening which is composed of the plurality of containers accommodating the biasing means, and wherein said lower layer is provided in a side thereof with a retaining slot; and wherein said elastic element is provided with a retaining projection engageable with said retaining slot.

15. The elastic footwear sole as defined in claim 14, wherein said containers are made integrally with said elastic member.

16. The elastic footwear sole as defined in claim 14, wherein said elastic member is provided with a plurality of cells for securing therein said containers.

17. The elastic footwear sole as defined in claim 14, wherein said containers are transparent.

18. The elastic footwear sole as defined in claim 14, wherein said containers are provided respectively therein with a predetermined amount of filler securing said biasing means retained in said containers.

19. The elastic footwear sole as defined in claim 14, wherein said containers are made integrally with said elastic element.

* * * * *